US005505510A

United States Patent [19]

Duncan

[11] Patent Number: 5,505,510

[45] Date of Patent: Apr. 9, 1996

[54] APPARATUS FOR RETRIEVING DISBURSED OBJECTS

[76] Inventor: James Duncan, 1521 NE. Dove Ave., Stuart, Fla. 34994

[21] Appl. No.: 368,008

[22] Filed: Jan. 3, 1995

[51] Int. Cl.[6] ..... A63B 47/02

[52] U.S. Cl. ..... 294/19.2

[58] Field of Search ..... 294/19.2; 56/328.1, 56/332; 273/32 D, 32 F, 162 A, 162 E, 162 F

[56] References Cited

U.S. PATENT DOCUMENTS

| | | | |
|---|---|---|---|
| 2,551,486 | 5/1951 | Burden | 294/19.2 |
| 2,760,807 | 8/1956 | Watson | 294/19.2 |
| 3,117,814 | 1/1964 | Webb | 294/19.2 |
| 3,412,897 | 11/1968 | Slater | 294/19.2 |
| 3,558,170 | 1/1971 | Stanworth | 294/19.2 |
| 3,901,545 | 8/1975 | Shott | 294/19.2 |
| 4,629,235 | 12/1986 | Logue | 294/19.2 |
| 5,188,410 | 2/1993 | Summers | 294/19.2 |

FOREIGN PATENT DOCUMENTS

| | | | |
|---|---|---|---|
| 1429211 | 1/1966 | France | 294/19.2 |
| 3132-761 | 3/1983 | Germany | 294/19.2 |
| 1125353 | 8/1968 | United Kingdom | 294/19.2 |

*Primary Examiner*—Dean Kramer
*Attorney, Agent, or Firm*—Kevin Redmond

[57] ABSTRACT

An apparatus for retrieving disbursed objects of various forms, and most importantly spherical objects, such as balls from a surface, such as the ground's surface, comprising a hollow tube having a centrally located longitudinal axis, a first and a second end with an opening at each end, detents located internally within and connected to the hollow tube near the first end of the tube, and a grip attached to the outside of the hollow tube near the second end of the tub. The detents are generally positioned in a single plane oriented orthogonally to the longitudinal axis and in close proximity to the first end of the hollow tube. In retrieving objects, the opening at the first end of the tube is positioned over the object to be retrieved. Downward pressure is applied to the grip to force the hollow tube down and over the object to be retrieved. The detents are initially forced away in a radial direction from the longitudinal axis, permitting the object to be retrieved to pass upward within the hollow tube past the location of the detents. The detents then return to their initial position retaining the object to be retrieved within the hollow tube at a location above the plane of the detents.

3 Claims, 1 Drawing Sheet

APPARATUS FOR RETRIEVING DISBURSED OBJECTS

BACKGROUND OF THE INVENTION

1. Field of the Invention

The present invention relates generally to devices for retrieving objects, and more particularly to manually operated devices for retrieving balls from the surface of the ground.

2. Description of the Prior Art

After a batting practice or driving practice session in many sports, such as softball, hard ball and golf, balls are usually left distributed widely over a field or driving range. The retrieval of the balls over this wide area by means of the usual manual method of retrieval requires a person to walk over to and pick up each ball. After a long practice session, this activity can become a time consuming and tiring effort. One of the most time consuming and most tiring portion of this retrieval process is the necessity to stop, bend over, and pick up each ball individually before proceeding to the retrieval of another ball. This portion of the process can be particularly difficult or even impossible for some people, especially those that suffer from back strain, or back injury. Indeed, the repeated bending over required in this process can itself induce back strain in people who are not accustomed to this type of physical activity.

The time and cost required by prior art retrieval methods is considerable. A practice session in a sport such as soft ball can be halted once all the practice balls have been hit. A two hour practice session can require up to an hour to retrieve all the balls and return them to the mound to continue the session or start a game. One prior art method of overcoming this type of delay in a practice session was to accept the expense of a larger supply of practice bails. A larger supply of balls, although more expensive, permitted the practice session to continue longer. However, this solution only made the task of clearing the field for a game following a practice session an even greater problem because of the added time required to clear the field of the increased number of balls.

There are mechanism available to aid in the retrieval process, but many are expensive and impractical for most application. For example, ride-on vehicles designed for retrieving golf balls are currently available, but their cost and maintenance is generally prohibitive for the individual or neighborhood athletic team. The disadvantages of prior art mechanisms and prior art manual retrieval systems are overcome by the present invention, as will be shown and described in the following specifications and claims.

SUMMARY

An object of the present invention is to provide a device for retrieving an object, such as a ball, from a surface, such as the surface of the ground, without the need for an operator to bend over to retrieve the object.

An object of the present invention is to provide a device for retrieving multiple objects from a surface without the need for an operator to stop at the location of each object.

An object of the present invention is to provide a device for retrieving objects which automatically stores such objects after retrieval, clearing the device for a second retrieval operation immediately after a first retrieval operation has been completed.

An object of the present invention is to provide a device which can discharge all stored objects in simple and rapid manner.

An object of the present invention is to provide a retrieval device for objects which is light to carry, simple to operate, low in cost, and rugged in construction.

The essential elements of a preferred embodiment of the present invention comprises a hollow tube with detents contained within the tube in close proximity to one end of the tube and a grip attached to the outside of the tube in close proximity to the opposite end of the tube. The tube is preferably formed of a resilient material such as PVC which can be deformed under heat and pressure to form the detents on the inside wall of the tube, using only the material in the walls of the tube itself to provide at low cost this important element of the invention. The resiliency of the PVC material provides the mechanism by which the detents may be depressed and return to their initial position without the need for other components to achieve this function.

In the operation the present invention, the tube is held generally vertically with the detents being located at the lower end and the grip being located at the upper end. The opening at the lower end of the tube is pushed down over a ball by means of applying pressure to the grip. As the ball is forced into the lower opening, it applies pressure on the detents, forcing them back against the wall of the tube, thereby permitting the ball to pass the position of the detents in the tube and come to rest above the detents where the ball is stored until the next ball is retrieved. When this operation is repeated on another ball, the first ball is simply moved up within the tube by the force of the next ball entering from below. The stored balls are easily collected when the tube is full. The tube is inverted and the balls simply drop from the end opposite the detents because there is no restraining device at this end of the tube.

Alternatively, for the storage of a relative small number of balls within the tube, a restraining device, such as a cap, may be placed over the opening at the second end to retain and store balls within the invention.

DETAILED DESCRIPTION OF THE INVENTION

Figure 1:
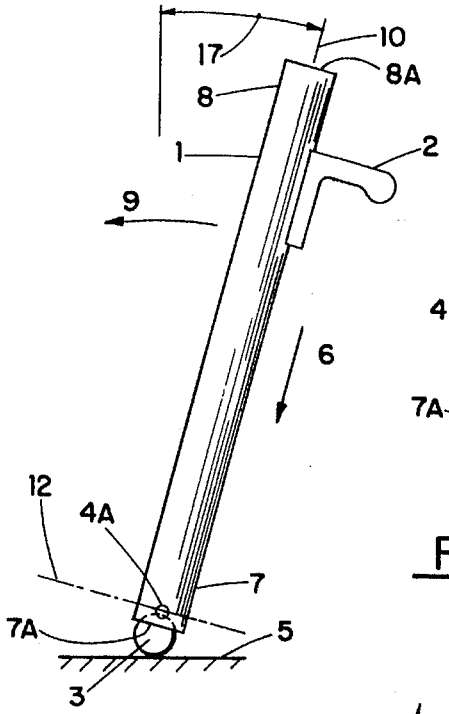
FIG. 1 is an outline drawing of the present invention showing the invention in a position to retrieve a ball through an opening in the lower end of the invention.

The essential elements of the invention are shown in FIG. 1. These elements comprise a cylindrical, hollow tube 1, a grip 2, and a detent 4A. The hollow tube has a thin wall with a generally uniform inside and outside diameter and a first opening 7A at the lower end 7 and a second opening 8A at the upper end 8, both openings providing access to the inside of the tube. The tube is normally held in a generally vertical position with the detent being located inside and attached to the tube in close proximity to the lower end of the tube. The grip is attached to the outside of the tube in close proximity to the upper end of the tube.

Figure 4:
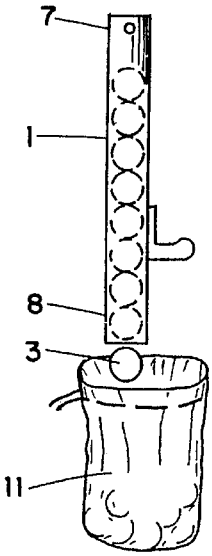
FIG. 4 is a side view of the invention showing the invention inverted over a bag for collecting the bails retained within the present invention, the balls being fed out of the invention and into the bag by gravity feed through a second opening in the invention located at the opposite end from the opening through which the balls were first retrieved.

In the operation of the invention, a generally downward force in the direction of the arrow 6 is manually applied to the grip, forcing a ball 3 located on the surface of the ground 5 into the opening at the lower end of the tube. As the ball progresses up the tube, its upper surface contacts and depresses the detent, allowing the ball to progress further up the tube past the detent, where it comes to rest and is stored until the next ball is retrieved. The next ball forces the first ball still further up the tube to a higher location in the tube where it is stored until it is removed from the invention. The process is repeated until the tube is full of balls, at which the time, the invention is inverted as shown in FIG. 4. The balls are permitted to fall unimpeded out of the tube opening 8A into a collecting receptacle, such as the bag 11 shown in FIG. 4.

In collecting a plurality of balls on a field, the operator will typically hold the invention at a small angle 17, of say 15 decrees to the vertical, when approaching a ball, as shown in FIG. 1, and then rotate the upper end of the invention a small amount in the direction of the arc 9 while continuing to apply downward pressure on the grip. In this way, the operator can continue walking while retrieving a ball. This eliminates not only the bending that was required with the prior art manual retrieval method, but eliminates the need to stop at each ball, greatly speeding the retrieval process, while at the same time making it easier and less fatiguing. The pick up motion is typically so fast that the operator usually does not even notice that the small arc is made with the upper portion of the invention while the operator continues his movement on towards the next ball, but the design and operation of the invention which makes this subtle motion possible results in a significant aid in speeding and facilitating the retrieval process.

This process can be accomplished so quickly that a field full of ball that ordinarily would have taken up to an hour to clear has been completely cleared in as little as 5 minutes, providing an increase in efficiency of twelve fold, while at the same requiring less physical effort.

Figure 2A:
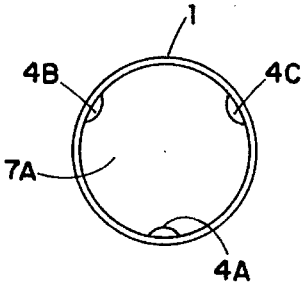
FIG. 2A is an end view of the present invention showing the location of detents within the hollow interior in close proximity to the lower end of the invention prior to the entry of the ball into the tube.

A plurality of detents, rather than the single detent, shown in FIG. 1 may be employed to improve the securing action of the detents in holding and supporting all the balls retrieved and stored in the tube above the detents. The location of these detents is facilitated by reference to a central longitudinal axis 10, shown in FIG. 1, which extends through the center of the tube. A plurality of detents, such as detents 4A, 4B, and 4C shown in FIG. 2A, are typically located in a single plane such as plane 12 shown in FIG. 1. Plane 12 is orthogonal to the central longitudinal axis of the tube and is positioned in close proximity to the lower end 7 of the tube 1. The distance of this plane from the end of the tube is typically less than one-half the diameter of the ball to be retrieved. At this distance from the lower end of the tube, pressure applied to a ball by the downward pressure applied to the invention in retrieval will result in forcing the center of the ball past plane 12 where the detents are located, thereby securing the ball above the detents in a storage location.

As can be seen in FIG. 2A, in a preferred embodiment of the invention, the detents have a generally rounded cross section which is designed to interact with the rounded surface of a ball as the ball is being retrieved. In the retrieval action, the ball is first forced up against the detents where initial contact is made. As the ball is then moved further upward within the tube to the point where the center of the ball lies in the plane of the detents, a cam action occurs between the curved surface of the ball and the detents, forcing the detents in an outward radial direction away from the central longitudinal axis of the tube. Further pressure on the ball results in its passing the plane of the detents. The pressure applied by the ball on the detents is then relieved and the detents return to their original position by means of an internal force contained within the detents themselves. With the detents returned to their original position, they secure the ball in a storage location in the tube above the detents.

The force returning the detents to their original position after the ball has passed into a storage position above the detents can be provided by a number of means. In a conventional arrangement, detents typically employ a depressible button, supported by a spring which is located in a cylindrical enclosure. The cylindrical enclosure for the spring is usually located in a support wall, such as the wall of the tube 1. Capture means holds the button in place at one end of the cylindrical enclosure. An external force applied to the button depresses it into the cylindrical enclosure. The button returns to its original position after the external force is removed from the button by means of a restoring force supplied by the spring which was compressed when the button was initially depressed. This type of conventional detent arrangement can be employed in the present invention. However, in a preferred embodiment of the present invention, all of the components of the conventional detent described above are eliminated, providing a significant cost saving and improvement in reliability.

Figure 2B:
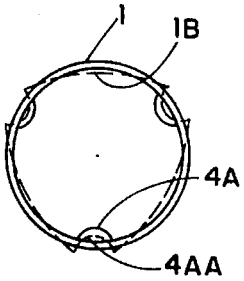
FIG. 2B is a an end view of the present invention showing the location of the detents when a ball is located in the plane of the detents.

In a preferred embodiment of the invention, the tube is formed of a resilient material such as PVC, which if deformed within its elastic limits, returns to its original shape, thereby enabling the tube itself to fill the function of a spring in a conventional detent. It can be seen in FIG. 2B that as the detents are forced away from the center of the tube by a ball, they lie in the position shown by the dashed line. The section of the tube wall between the detents is deformed by being drawn in towards the center of the tube. This position of the walls is also shown by dashed line. Once the ball has passed above the detents, the resilience of the tube wall causes the detents and the wall to return to the original position, as shown by the solid lines in this Figure.

Figure 3A:
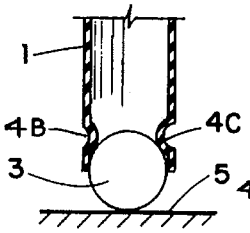
FIG. 3A is a sectional side view of the present invention showing a ball located partially within the opening at the lower end of the invention with the upper surface of the ball in contact with the lower surfaces of detents.
Figure 3B:
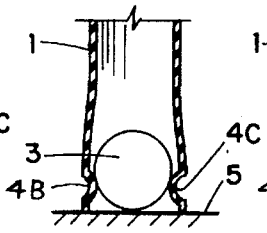
FIG. 3B is a sectional side view of the present invention showing a ball located totally within the opening in the lower end of the invention where the side surfaces of the ball are in contact with the side surfaces of detents, and the ball, by virtue of its size and this location, depresses the detents in a direction radially away from central longitudinal axis of the invention.
Figure 3C:
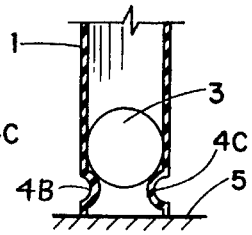
FIG. 3C is a side view of the present invention showing a ball located totally within the opening in the lower end of the invention with the lower surface of the ball in contact with the upper surface of the detents, and the ball, by virtue of this location, rests on and is held within the invention by the detents.

The interaction of the ball and the detents is shown in detail in FIG. 3A, 3B and 3C. In FIG. 3A, the ball 3 is located partially within the lower end of tube 1. Detents 4B and 4C are shown in contact with the top of ball 3. In FIG. 3B, the center of ball 3 has been pushed up slightly past the location of the detents within the tube. The detents 4B and 4C are shown to be forced away from the center of the tube in a radial direction. In FIG. 3C, the ball lies entirely above the detents and the detents have returned to their original position. As can be readily understood, the amount of expansion of the tube to pass the ball is exaggerated in FIG. 3 B to more clearly illustrate the movement of the detents as the ball is forced upwards within the tube. Typically, the actual depression of the detents is less than one sixteenth of an inch.

The detents are easily and economically produced by applying, under pressure, a heated metal die to the outside wall of the tube at the desired location for the detent. For PVC, the pressure is typically less than 1.0 pounds per square inch and the temperature is typically 200 degrees F. This pressure is applied for less than 5 seconds. As can be readily understood by those skilled in the art, different temperatures, pressures and time cycles may be employed to achieve similar results, depending on the processes and the materials used. In the detent forming process, typically a stop is provided for the form to prevent the detents from protruding within the tube beyond a prescribed depth. For example, for a retrieval device designed for balls used in the game of soft ball, the detent penetration is typically 0.375 inch within a PVC tube having an inside diameter of 4.2 inches. The diameter of the detent is typically 0.7 to 1 inch. These times, temperatures, pressures, and dimensions are illustrative only and are not intended to limit the scope of the invention.

Since a preferred embodiment of the invention is produced from a plastic, such as PVC, it is possible to mass produce the entire invention, forming the detents and joining a molded plastic grip by bonding or molding the grip directly to the tube in a continuous operation and thereby gain the lower unit cost possible from such an automated production line. However, large production runs are not always necessary, especially for initial production, and the set up cost for small runs on equipment designed for large runs is prohibitive.

Fortunately, the present invention can be produced economically in a variety of ways to satisfy the quantity required at a particular time. For example, it is possible to produce the present invention economically in much shorter production runs. In such a production run, the detents can be produced as described above in a first separate manual or semiautomatic operation where jigs would be employed to hold the tube and control the depth of penetration of the detent forms into the wall of the tube. The grip can be produced separately in molded plastic or milled from metal or wood and then attached in a second assembly operation to the tube. This second operation can be completely manual, or can be done manually with the aid of some basic jigs and fixtures, depending on the quantity of units desired.

Figure 5A:
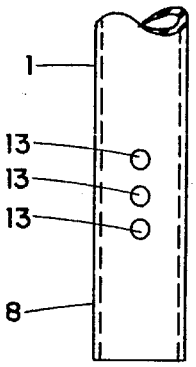
FIG. 5A is a side view of a portion of the present invention near the upper end of the invention exhibiting a first set of three holes located in the side of the invention designed to provide access to fastening devices, such as screws, used to secure a grip to the invention.
Figure 5B:
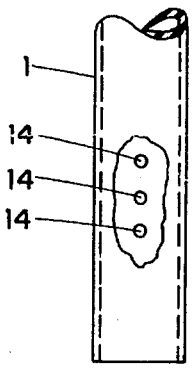
FIG. 5B is the identical side view of the invention as described in connection with FIG. 5A with the exception that the near wall of the invention is broken away to show the inside of the far wall which contains a second set of three holes aligned with the first set and designed to hold fastening devices, such as screws, to secure a grip to the present invention.
Figure 5C:
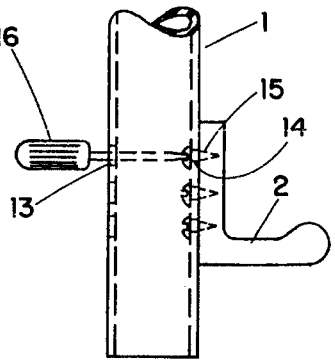
FIG. 5C is a side view of the identical portion of the invention as described in connection with FIG. 5B with the exception that this portion of the invention has been rotated 90 degrees to illustrate the location of three screws held in the second set of three holes and to illustrate the way in which these screws are used to secure the grip to the side wall of the invention.

A simple and economical method for manual attachment is shown in FIGS. 5A, 5B, and 5C. FIG. 5A shows a section of the tube 1 in which a first set of three holes 13 is drilled in the side wall of the tube 1 at a level on the tube at which the grip is to be attached. This first set of holes is designed to provide access to fasteners that are located on the wall of the tube that is directly opposite the location of the these holes.

FIG. 5B is an identical view of the tube as was presented in FIG. 5A, with the exception that the near wall that contained the first set of three holes has been broken away to expose the far wall of the tube. The far wall contains a second set of three holes 14 which are designed to hold fasteners used to secure a grip 2 to the tube wall. The second set of three holes is generally located directly opposite the first set and can be machined in the tube walls simultaneously with the first set by extending the drill bit through the center of the tube into the opposite wall when drilling the first set of holes.

FIG. 5C shows the same section of the tube as was shown in FIGS. 5A and 5B; however, the tube 1 has been rotated so that a side view of the second set of holes 14 is positioned on the right side of FIG. 5C. Also shown in FIG. 5C are three fasteners 15. Screws are used in this Figure to represent the fasteners As can be seen in FIG. 5C, the three fasteners pass through the second set of holes 14 and into the grip 2 to secure the grip to the tube wall. Access to tighten the fasteners into the grip is provided by the first set of three holes 13. The use of the first set of three holes for access is illustrated by a screw driver 16 which is shown with its shank passing through the upper hole of the first set of holes to reach the first fastener held in the upper hole of the second set of three holes. This simple, but effective and economical method of assembly has been used successfully in prototype and initial production runs.

Although the present invention in its preferred embodiment has been illustrated as being used in connection with the retrieval of balls associated with athletic games, the invention is not limited to such applications. The present invention can be applied to the retrieval of other objects such as metal balls in machine, where for example ball bearings could be retrieved and collected. In addition, the scope of the present invention is not limited to the retrieval of round or spherical objects such as balls. The cross section of the tube can be made to accommodate various objects with symmetrical cross sections such as rectangular or octagonal and to nonsymmetrical cross sections as the particular application requires. Similarly, the location of the detents is not restricted to a single plane located only at one end of the tube. The number and location may be varied to accommodate the object to be retrieved. Further, the application of pressure on the object to to be retrieved to force it through the tube can be supplied in a number of ways including machine supplied pressure on the tube or pressure applied directly on the object to be retrieved. Included within the spirit and scope of this invention are such other variations that will become obvious to those skilled in the art, the scope of the invention being limited only by the breath of the following appended claims.

Having described my invention, I claim:

1. Apparatus for retrieving a generally spherical object comprising:

(a) a tube having a regular circular cross section and a hollow interior and a first opening in said tube to said hollow interior, said first opening and said hollow interior being sufficiently large to pass said object through said first opening and into said hollow interior, said tube having having a central longitudinal axis and said first opening being formed by cutting said tube in a plain generally orthogonal to said longitudinal axis, (b) a plurality of detents located within said hollow tube and attached to the inside wall of said tube, said detents having a contact area projecting into the hollow interior of said tube to make contact with said object as said object is forced past the location of said detents in said tube said detents being released and returning to their original undepressed position after said object is forced past said detents, said detents being in the form of distinct projections covering only a portion of the inside wall of said tube, said detents being distributed about said tube in a plane generally orthogonal to said central axis at a distance from said first opening that is less than one-half the diameter of said object, said tube being formed of a resilient material and said detents being formed directly from the wall material of said tube by producing projections of the wall material on the inside of the tube (c) a grip, attached on the outside of said tube said grip accepting a force applied to it and transmitting said force to said tube.

2. Apparatus as claimed in claim 1 wherein said resilient material is a plastic.

3. Apparatus as claimed in claim 2 wherein said plastic is PVC.

* * * * *